United States Patent [19]

Bombled

[11] 4,065,061

[45] Dec. 27, 1977

[54] BALL MILL

[76] Inventor: Jean-Paul Bombled, 89 bis, rue des Fermettes, 78420 Carrieres sur Seine, France

[21] Appl. No.: 757,225

[22] Filed: Dec. 21, 1976

[30] Foreign Application Priority Data

Jan. 8, 1976 France ..... 76.00309

[51] Int. Cl.[2] ..... B02C 23/08

[52] U.S. Cl. ..... 241/81; 241/97; 241/171; 241/273; 241/274; 241/284

[58] Field of Search ..... 241/79.1, 81, 97, 152 A, 241/153, 170, 171, 270, 273, 274, 284

[56] References Cited

U.S. PATENT DOCUMENTS

| | | | |
|---|---|---|---|
| 2,006,269 | 6/1935 | Hadsel | 241/274 |
| 2,032,247 | 2/1936 | Beers | 241/274 |
| 2,047,171 | 7/1936 | Ball | 241/274 |
| 2,468,321 | 4/1949 | Bland | 241/81 |
| 3,055,597 | 9/1962 | Mand | 241/81 |

*Primary Examiner*—Granville Y. Custer, Jr.
*Attorney, Agent, or Firm*—Young & Thompson

[57] ABSTRACT

A novel ball mill providing a maximum efficiency for the balls dropping onto the material to be crushed, this being obtained by associating a vertical tube into which said material is poured together with the balls with means for raising the balls and crushed material passing out of the lower end of the tube, so as to reintroduce same into the upper end of the latter, the sufficiently crushed material being sucked out of the tube at a selected point of its height.

4 Claims, 1 Drawing Figure

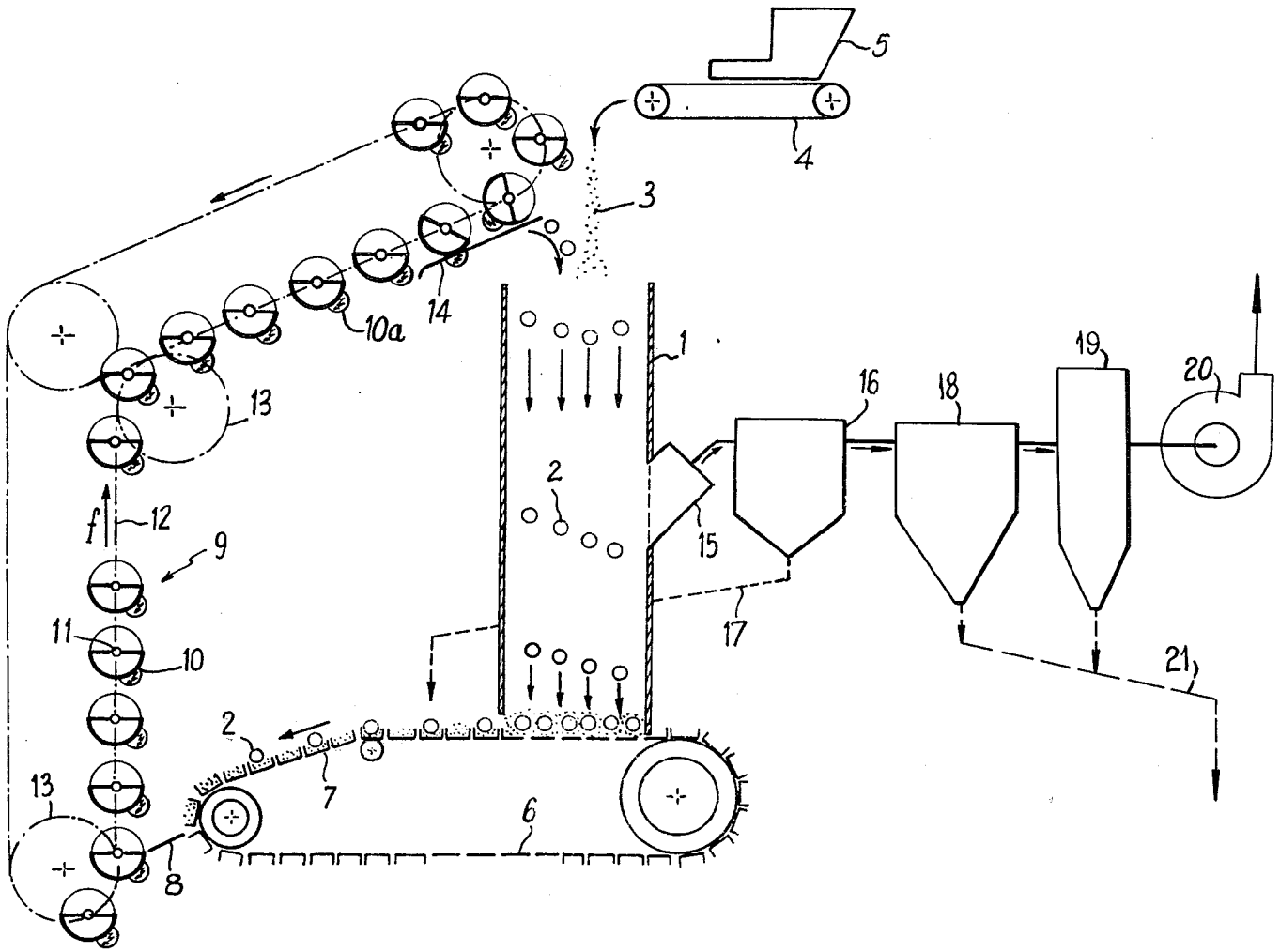
1
2
3
4
5
6
7
8
9
10
10a
11
12
13
14
15
16
17
18
19
20
21
f

BALL MILL

Crusher mills are known nowadays which include one or more rotary chambers wherein balls are carried which act on the material to be crushed. During the rotation of such chambers, the balls impinge on the material and ensure its crushing.

The efficiency of a ball mill depends on the force with which the balls hit the material to be crushed and this force depends in its turn on how high the balls are allowed to fall. Now, in a rotary ball mill, the height of drop is only a fraction of diameter of the chamber and consequently, if it is desired to increase this height, it is necessary to correspondingly increase said diameter. Since the load in the chamber varies with the square of its diameter and the power and throughput of the mill are proportional to a 2.5 power of said diameter, the tendency is to produce mills which are exceedingly bulky and require a considerable power.

Furthermore, the height of drop in a rotary ball mill is equal to about 80% of the diameter of the chamber for those balls which are located in the outer layers, but it is much smaller, of a magnitude of about half the diameter for the balls which are located in the core of the load. Thus all the balls cannot drop by the same height and are not equally efficient.

Lastly, if the rotary speed of chamber or the rate of filling are too far from their optimum values, it is impossible to raise the load by a sufficient amount inside the chamber. In all cases, during such a raising of the load, which raising lasts during about 50 to 60% of the operative cycle, the balls execute no work and are inoperative.

Now, my invention has for its object improvements in a ball mill or a crusher operating with balls or the like crushing parts, such as to remove the above drawbacks.

My improved ball crusher includes a stationary substantially vertical tube, means for feeding the material to be crushed into the upper end of the tube together with the balls, means for removing the balls and crushed material out of the lower end of the tube, means for raising the balls back into the upper end of the tube and means for separating the crushed material from the balls at a predetermined point of the circuit through which the balls are caused to pass.

During operation, the material to be crushed drops inside the tube and forms a layer on which the balls drop in their turn, so as to crush same. The height of drop may readily reach a high value, say 7 to 10 meters, so that the crushing operation is highly efficient. All the balls drop by the same height. The balls and the crushed material are then removed out of the lower end of the tube and raised again together possibly with the crushed material up to the upper end of the tube into which they are returned, the crushed material being separated from the balls at predetermined point of the circuit executed by the balls.

The means for removing the balls and the crushed material out of the lower end of the tube may be constituted by a sheeted endless conveyor located underneath the tube. If the speed of the conveyor is suitably adjusted, its sheeting permanently carries a coat of balls and crushed material, the thickness of which is sufficient for it to prevent any hammering. Since the conveyor lies outside the tube, it is possible to replace quickly and easily any worn parts of its sheeting. In the case of small-sized ball mills, it is possible to resort to a vibratory channel instead of a sheeted conveyor.

According to an advantageous embodiment of my invention, the mill includes means for raising simultaneously the balls and crushed material and reintroducing same into the tube while a channel is provided for removing the crushed material out of the tube, said channel being connected with suction means through a separator.

Such means for raising the balls and the crushed material are constituted preferably by an elevator carrying a succession of vibratory scoops. While the balls and crushed material are being raised, the balls perfect the crushing and destroy all granular agglomerates. Thus, the balls execute their work twice during each crushing cycle and are operative practically throughout said cycle. There is consequently no drawback in resorting to low raising speeds.

I have described hereinafter by way of example and by no means in a binding sense, an embodiment of my improved crusher, reference being made to the single FIG. of the accompanying drawing showing said crusher in a diagrammatic manner.

As illustrated, the crusher includes a vertical tube 1 inside which the balls 2 and the material to be crushed 3 are caused to drop. The material to be crushed is fed out of a distributor constituted, in the case considered, by an endless conveyor 4 fed by a hopper 5 located above it, the downstream end of the conveyor extending over the upper end of the tube 1.

Underneath the lower end of the tube 1, there lies another endless conveyor 6 constituted by a succession of pivotally interconnected sheeted compartments. The front end of this conveyor 6 is adapted to feed a slanting carrier plate 8 leading to an elevator 9. The latter is constituted by a succession of scoops or buckets 10, by vibrators 10*a*, each of which scoops is pivotally carried through the agency of a horizontal spindle 11 incorporated with endless chains 12. These chains 12 are guided over a number of toothed wheels such as 13, one of which drives the chains, the arrangement of the wheels being such that the scoops move along a path which leads them over the upper end of the tube 1. Each scoop is provided with a vibrator 10*a*. Adjacent the upper end of the tube 1, a plate 14 is provided which is swept by the successive scoops as they are about to reach the upper end of the tube 1, whereby said scoops are caused to roll over the plate 14 and to pivot round their spindles 11, and pour their contents into the tube 1.

Into the medial section of the vertical tube 1, there opens a suction sheath 15 which is connected with a sorting selector 16. The lower end of this sorting selector opens into a channel 17 the lower end of which lies over the endless conveyor 6. On the other hand, the upper output of the sorting selector is connected with a separator 18 connected in its turn through the filter 19 with a suction fan 20. The lower ends of the separator 18 and of the filter 19 open into a channel 21 through which the crushed products are removed.

During operation, the material to be crushed 3 is poured into the hopper 5 and fed by the upper conveyor 4 into the upper end of the tube 1, so as to fall throughout the height of the latter. The material drops thus onto the lower conveyor 6 on which it forms a layer onto which the balls 2 drop so as to crush the material.

The balls admixed with the crushed material are then fed by the conveyor 6 over the plate 8 and thence into the scoops 10. Each of the latter is caused to rise, as illustrated by the arrow *f*, by the chains 12 up to a point lying over the upper end of the tube 1. During this movement of the scoops, the latter are set into vibration so that the balls 2 hit the material and provide a further crushing of the latter.

When a scoop is about to reach the point overlying the tube 1, it engages the plate 14 and rolls over the latter; consequently, the scoop rocks as it passes over the tube 1 and drops its contents into the latter. The scoop then moves off the plate 14 and returns through gravity into its original angular setting, the scoop returning finally through the action of the chains 12 underneath the outer end of the lower plate 8 so as to be filled again.

The scoops thus filled again rise and cause the balls 3 to drop with the crushed material inside the tube 1. The portion of material which has been sufficiently crushed is sucked out of the tube into the suction sheath 15 as provided by the reduction in pressure produced by the suction fan 20, so that said crushed material enters the selector 16. The material which has been most comminited passes together with the suction air into the separator 18 whereas the remaining material is returned through the channel 17 onto the lower conveyor 6 which feeds it again into the scoops 10 to be subjected to a further finishing crushing. The air is removed through the filter 19 and the crushed material is removed through the channel 21.

In the case of small amounts of material or of particularly hard materials, it is possible to make the mill operate in a discontinuous manner; this may be performed by stopping the feed of material to be crushed as soon as the amount of the latter inside the mill has reached a predetermined value, while the suction sheath 15 is rendered inoperative.

The ratio R between the speed of the lower conveyor 6 and that of the elevator 9 should be constant. However, if the speeds are increased with a ratio R remaining constant, the frequency of the shocks in the tube is increased and the relative duration of the vibratory crushing action in the scoops is reduced and conversely.

If the vertical two-staged mill described is considered as a double crusher comprising a preparatory and a finishing crusher or again as a single crusher comprising two compartments, it is apparent that a mere speed adjustment provides means for giving a greater importance to either crushing stage, somewhat in the same manner as if the sifting grate were shifted by a mere adjustment of the speed controlling means.

Such an adjustment can be performed in accordance with the nature of the material to be crushed: a crumbly material or a material liable to agglomerate requires a lesser number of shocks but more frictional wear and disintegration through vibration and the case is the same when a great fineness is sought for and conversely a harder material or a material to be crushed more roughly requires more shocks and less frictional wear and disintegration.

Obviously, my invention should not be considered as restricted to the sole embodiment described and illustrated and, in contradistinction, it includes all the modifications thereof falling within the scope of the accompanying claims.

What I claim is:

1. A ball crusher comprising a stationary substantially vertical tube, means for feeding the material to be crushed into the upper end of said tube together with crusher balls to drop same into the tube, means for removing said balls and the crushed material out of the lower end of the tube, means for raising the balls thus removed together with any insufficiently crushed material up to the upper end of the tube to return same into the latter and means for separating at least part of the crushed material from the balls at a predetermined point of its travel inside the tube and removing and raising means to discharge said crushed material.

2. A ball mill as claimed in claim 1, wherein the means removing the balls and crushed material out of the lower end of the tube are constituted by a sheeted endless conveyor extending underneath the lower end of the tube.

3. A ball mill as claimed in claim 1 wherein the separating means include an exhaust channel for the crushed material, a separator connecting said channel with the tube at a selected level thereof and suction means controlling said separator to urge the crushed material out of the tube into the separator to drop out of same into the exhaust channel.

4. A ball mill as claimed in claim 1, wherein the raising means include an elevator constituted by a chain of interconnected vibratory scoops.

* * * * *